US005759114A

United States Patent [19]

Bluto et al.

[11] Patent Number: 5,759,114

[45] Date of Patent: Jun. 2, 1998

[54] BELL-SHAPED PUTTER WITH COUNTERWEIGHT AND OFFSET SHAFT

[75] Inventors: William Joseph Bluto, Newton Falls; Jeff Todd Powers, Deerfield, both of Ohio

[73] Assignee: John McGee, Warren, Ohio

[21] Appl. No.: 800,343

[22] Filed: Feb. 14, 1997

[51] Int. Cl.[6] ..... A63B 53/04

[52] U.S. Cl. ..... 473/340; 473/341; 473/313

[58] Field of Search ..... 473/340, 341, 473/342, 330, 329, 313, 314, 328, 349, 334, 337

[56] References Cited

U.S. PATENT DOCUMENTS

| | | | |
|---|---|---|---|
| 1,703,199 | 2/1929 | McClure | 473/340 |
| 3,085,804 | 4/1963 | Pieper | 473/340 |
| 4,522,405 | 6/1985 | Clawges | 473/340 |
| 4,872,683 | 10/1989 | Doran et al. | 473/340 |
| 5,340,106 | 8/1994 | Ravaris | 473/341 |
| 5,630,766 | 5/1997 | Granelli | 473/340 |

*Primary Examiner*—Steven B. Wong
*Attorney, Agent, or Firm*—Robert G. Lev

[57] ABSTRACT

A golf putter provides improved power, control and "feel" with a special head configuration including a counterweight as well as a hosel and striking portion. The counterweight extends behind the striking portion and has a horizontal centroid that aligns with that of the striking portion. The hosel connects the shaft to the head via the portion of the counterweight that is opposite the connection to the striking portion. A beveled surface connects the lower surface of the striking portion to the vertical striking face thereby facilitating an easier stroke.

12 Claims, 1 Drawing Sheet

BELL-SHAPED PUTTER WITH COUNTERWEIGHT AND OFFSET SHAFT

TECHNICAL FIELD

This field of the present invention relates generally to golf putters, and more particulary to a golf putter configured to easily line up the direction of a golf shot with the direction of momentum of the putter swing.

BACKGROUND OF THE INVENTION

Putters in many shapes and configurations have been on the market but none has yet been developed that will reliably propel a golf ball across a putting surface accurately, and in a desired direction when used by a relatively unskilled golfer. The so-called center-shafted putters with portions forming a toe and a heal of a head arranged on opposite sides of a shaft are essentially unstable. This situation is due to the fact that the golf putter head is essentially unbalanced permitting skew in variety of different directions, resulting in the failure of the line of momentum of the golf putter head to coincide with the optimum striking point on the ball for a desired direction of ball travel. The golfer, unless highly skilled, has very little in the way of avoiding skewing the putter head during the swing. Nor does such a golfer have much aid to keep the putter head in the proper position so as to coincide the direction of the putter head momentum with that of the desired direction of ball travel.

One solution was proposed by Walker in UK Patent No. GB2255287A, incorporated herein by reference. This arrangement includes a putting head mounted on a shaft with the putting head being provided to be entirely symmetrical on opposite sides of the shaft and further including a middle portion including a surface for striking the ball and substantially identically formed portions projecting from the middle portion to constitute a heal and toe of the head of the putter. An under surface of the putter is constituted by an arcuate strip of substantially equal width throughout the length of the putter head. Preferably the entire putting head is of substantially equal width. A recess is provided in an upper face of the putting head and maybe angled to one side or the other with the line of symmetry of the head to provide divergence from the vertical to the toe-heal plane of at least 10° required by the rules of golf. Alternately the aperture which receives the shaft may be provided in the line of symmetry, and an angle of diversion provided by an angle in a portion of the shaft at a position spaced from the head. The overall shape of the putter head resembles a bell which curves up very sharply on either end so that a highly arcuate shape results along the bottom surface of the putter head. This design provides no measures by which the momentum of the shaft can easily be lined up with the desired direction of the golf shot. Further, because of the highly arcuate shape of the lower edge of the putter head, placing the "sweet spot" of the putter head against the desired portion of the ball is problematical.

An alternative design, blade type putters have relatively narrow putting faces which are frequently positioned too high or too low for properly propelling the ball in the desired direction. For example, when the narrow band putting face impacts the ball beneath its horizontal diameter, the ball will bounce and deflect from the putting line. In contrast, raising the narrow band putting face to impact ball above the horizontal diameter thereof will drive the ball into the putting surface and spoil the momentum of the putt. These problems are addressed in U.S. Pat. No. 4,314,701 to Swanson, incorporated herein by reference. In this design a golf putter has a generally rectangular blade head with a front putting face, a substantially flat rocker bottom, an upright back wall, and a central cylindrical portion having a diameter matching the diameter of a golf ball to be putted. Narrow heal and toe portions project laterally on either side from the central cylindrical portion. The top half of the cylindrical portion extends above the heal and toe portion and matches the top half of the golf ball to be easily aligned behind the ball so as to present a "sweet spot" on the putting face at the access of the cylindrical portion. However, in this design the "sweet spot" is relatively small, and easily twisted out of alignment with the desired direction of travel of the golf shot.

Various other devices for guiding the vertical position of a putter striking face relative to the ground surface have been used in the past, including units which have rollers to provide reduced friction, as well as clubs which have replaceable skid plates. U.S. Pat. No. 2,057,275 discloses a club that has a retractable spacing stand which is intended to space the bottom of the club at a predetermined distance from the ground at the beginning of a stroke. However, this is primarily used for drivers.

Soleplates have been used in golf clubs as well, and such plates are shown in U.S. Pat. No. 1,289,192. Replaceable bottom plates are also disclosed in U.S. Pat. Nos. 2,328,583 and 2,332,342. In these last two examples, the removable sections are used so that weight can be added or subtracted from the golf club. U.S. Pat. Nos. 2,255,332 and 3,680,868 disclose roller balls on the bottom surface of golf clubs to reduce friction. These rollers are replaceable, and can vary in size. However, none of these examples teaches the use of a runner on the bottom of the head that provides a smooth low friction surface and which is also adjusted to ensure that the most likely impact point will be close to the "sweet spot" of the club.

U.S. Pat. No. 4,832,344 to Werner incorporated herein by reference, discloses a golf club having an interchangeable runner on the bottom that is held in place with screws or double sided adhesive tape. The runner is capable of being shimmed or changed by an individual golfer to vary the vertical height or thickness in order to raise or lower the face of the club and thus adjust the position of the "sweet spot" of the club. The desired location of the "sweet spot" is determined by finding the center marking of the normal ball impact distribution for a plurality of impact points on a marking taped placed on the face of the club. A siting line can also be aligned with the center of the pattern of the impact points. However, there is no technique disclosed in this patent previously to ensure that the momentum of the golf head will be in the desired direction of the golf shot.

U.S. Pat. No. 5,533,730 to Ruvang incorporated herein by reference, discloses an adjustable golf putter providing variable configurations in the characteristics of the striking face-to-shaft lateral alignment, the center of gravity, the shaft-to-head longitudinal alignment, the head-to-shaft angle, the total weight, the weight distribution, and arrangements for targeting. In one arrangement the golf club is constituted by a shaft attached to a putter head where the head having the hosel assembly and weight assembly clamped between opposing face plates. However, there is nothing in any of the arrangements disclosed in this patent that offers techniques for ensuring that the momentum of the golf swing will be in line with that of the desired direction of the golf shot.

One solution to the aforementioned problems in putter and ball alignment has been the face-balance putter. Such putters are described in U.S. Pat. Nos. 5,290,035; 5,226,654; 5,078,398; 4,852,879; 3,954,254; 2,820,638; and, U.S. Pat. No. Des 221,446, all incorporated herein by reference. In this type of putter, the axis of the shaft intersects with the center of gravity of the putter head or intersects a line which extends to the center of gravity perpendicularly to the striking face of the putter. One desirable objective in designing a putter is to allow top-line alignment. The top line of the putter (the upper edge of the striking face) should be square or perpendicular to the intended line of travel of the golf shot. Therefore, it is desirable to allow the golfer to view as much of the top-line of the striking surface as possible when addressing the ball. The view of the portion of the top-line which is behind the ball is especially crucial.

Another well-known putter in the conventional art is the offset hosel putter. These putters are disclosed in U.S. Pat. Nos. 5,226,654; 4,948,140; 4,852,879; 4,832,340; 4,693,478; 4,265,452; 3,954,265; 3,923,308; and, U.S. Pat. No. Des 221,446, all incorporated herein by reference. In a putter with an offset hosel, the shaft is positioned forwardly of the face so that an extension of the center line of the shaft would not intersect the putter head and would pass forward of the face of the putter.

One problem with conventional putters with an offset hosel is that optimum top alignment is not permitted because the hosel is positioned too far from the heal (of the putting head), and obstructs a portion of the top-line (of the putting face) behind the ball. Examples of this drawback are found in the devices of U.S. Pat. Nos. 5,226,654; 4,852,878; and, U.S. Pat. No. Des 221,446.

A solution to this situation is found in U.S. Pat. No. 5,544,883, incorporated herein by reference, which discloses a face-balanced putter having an offset hosel which is configured to permit top-line alignment between the putter and the golf ball. The hosel includes a bottom portion which extends upwardly from the heal portion of the putter, a forwardly extending portion which extends forwardly beyond the face of the putter, a laterally extending portion which is extended forwardly of the face, and a socket for supporting a shaft.

While there have been numerous designs in golf putters for aligning the striking surface with a golf ball, little has been done to align the actual momentum of the club with the desired line of travel of the golf ball. An improved golf putter would encompass the aforementioned features of face alignment while still providing a method of better controlling the direction of the momentum of the club.

SUMMARY OF THE INVENTION

It is an object of the present invention to minimize skewing in any direction when striking a golf ball with a putter.

It is another object of the present invention to align the momentum of the head of the golf putter with the desired direction of travel of the golf ball being struck.

It is a further object of the present invention to improve the "feel" of a golf putter.

It is yet another object of the present invention to provide a golf putter that allows better control of every aspect of the putting operation.

It is still a further object of the present invention to more easily apply additional power to a golf putt with minimum additional effort in the swing.

It is yet an additional object of the present invention to provide a golf putter that can be adjusted in weight, front-to-rear balance and side-to-side balance based upon personal preference of the golfer without undermining the basic design or effectiveness of the putter.

These and other objects of the present invention are achieved using a golf putter including: a head, a shaft and a hosel connecting the head and the shaft. The head includes a substantial bell-shaped striking portion with a striking surface arranged along a substantially vertical plane. The striking portion also has horizontal centroid and a lower surface arranged along substantially horizontal plane. The lower surface and the striking surface are connected to each other by a beveled surface. Also included is a counterweight having a longitudinal axis extending from the striking portion in a direction perpendictular and opposite the striking surface. The counterweight also has a centroid extending along the longitudinal axis of the counterweight and aligned with the centroid of the striking portion. The hosel is connected to the counterweight opposite the striking portion and extends at and angle upward from the counterweight and towards the striking surface. The shaft is connected at the end of the hosel opposite the connection between the hosel and the counterweight.

DRAWINGS

FIG. 1*a* is a front view of the striking face of the golf putter head.

FIG. 1*b* is a side view of the golf putter head.

DETAILED DESCRIPTION OF THE PREFERRED EMBODIMENTS

Figure 1A:
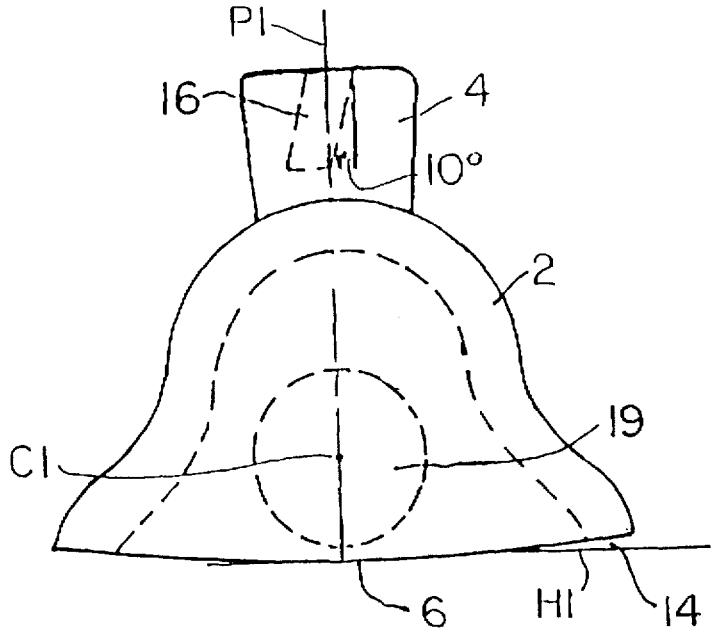
Figure 1B:
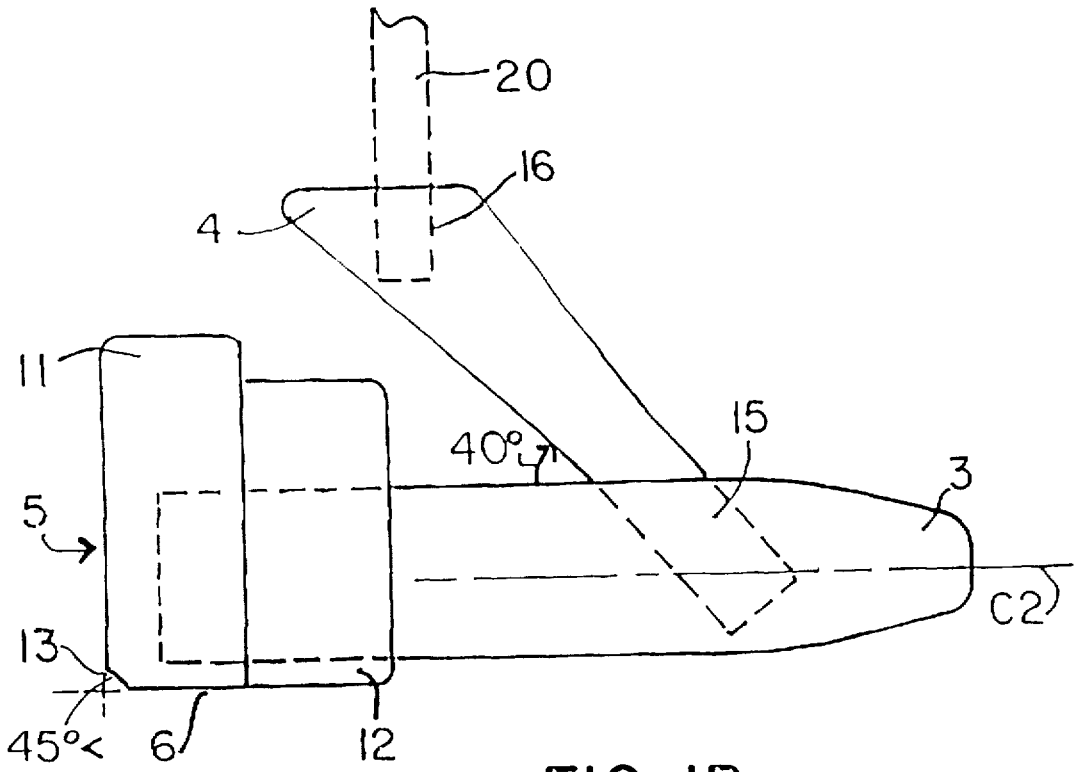

To better understand the present invention the front view of FIG. 1*a* and the side view of FIG. 1*b* are best studied together. The invention resides in the putter head 1, and can be used with any suitable shaft 20. While the shaft itself is not important to the present invention, the point at which the shaft is connected to hosel 4 can be very important to the overall performance of the inventive putter head as well as conventional putter heads.

Unlike most golf putters, the hosel 4 of the present invention is not connected directly to the striking portion 2. Rather, the hosel connects to a counterweight 3 which in turn is connected to the striking portion. As shown in FIG. 1*b*, the striking portion is constituted by two sections 11 and 12, each substantially formed in the shape of a bell. The larger of the two sections 11 contains the striking surface 5, which is designed to impact the ball, preferably in a substantially vertical plane. The second section 12 is smaller in diameter, and formed to the first section in a substantially step configuration. However, the overall configuration of the striking portion need not be the two sections depicted in FIG. 1*b*. Rather, striking portion can be formed of a single section to smoothly connect to the counterweight without any of the step configurations depicted in FIG. 1*b*.

A key aspect of the present invention is the relationship of the striking portion 2 to the counterweight 3. As shown in FIG. 1*b*, the counterweight extends into both sections 11 and 12 constituting the striking portion 2. However, such a configuration is not absolutely necessary, and the counterweight can be joined to the striking portion in any appropriate manner known in this art. Rather, the relationship between the centroid C2 of the counterweight and the centroid C1 of the striking portion is a key functional element of the present invention. The connections and thickness configurations between the counterweight and the striking portion are configured so that the two centroids align with each other, thereby facilitating better control of the momentum and motion of the putter.

While the depth configuration of the striking portion 2 can be configured in a way necessary to align the centroid C1 of the striking portion with the centroid C2 of the counterweight, the configuration of the striking surface 5 must be substantially that of a bell-shape. This configuration helps to balance the side-to-side weight of the putter head 1 in order to prevent skewing or inadvertent twisting of the putter head with respect to the desired direction of ball movement. The bell-shape also helps to facilitate a large "sweet spot" which coincides with the centroid C1 of the striking portion. This "sweet spot" is further enhanced by virtue of the fact that the centroid C2 of counterweight 3 is aligned with centroid C1. Thus, the considerable mass of the full putter head 1 is easily directed into the ball with very little effort on the part of the user. The centroid C1 is also positioned by virtue of the bell-shape so that it is approximately at the horizontal diameter of a ball placed on a horizontal surface H1 along which the bottom surface 6 of the striking portion will move.

The dimension D1 between the centroid C1 and the horizontal surface H1 may be designed to be slightly less than the height of the horizontal diameter of a golf ball in order to allow the golfer to slightly lift the putter head to accommodating easier movement along horizontal surface H1. However, this variation will probably be so slight as to be insignificant.

Easy movement of the lower surface 6 of putter head 1 over horizontal surface H1 is facilitated by beveled surface 13. Because of this bevel, there is far less likelihood of the striking face 5 being impeded by minor obstructions on horizontal surface H1 (upon which the golf ball rests). The use of the bevel is critical to the overall design of the inventive golf head 1, allowing much smoother movement of the head over the horizontal surface. Preferably, the beveled surface has a 45° angle with respect to the lower surface 6 and the striking surface 5.

To further facilitate easy movement of the putter head 1 along horizontal surface H1, the peaks on either side of the bell-shaped structure striking portion 2 are turned upwards at angles designated 14 in FIG. 1. This arrangement helps avoid inadvertent fouling of the putter head 1 with obstructions on horizontal surface H1 thereby facilitating a much smoother putting stroke. Preferably, angles 14 are approximately 3°, just sufficient to avoid inadvertent contact with obstacles on the horizontal surface, thereby avoiding accidental skewing during the putting stroke.

The use of counterweight 3 adds to the weight and thereby the power of the putter. Additional weight and control of it facilitates a much better "feel" than is found in conventional golf putters. There is also much less of the putter twisting or skewing in various directions during the golf stroke. Because of the inventive design there is much less difficulty in "feeling" where the putter head is moving and how it will strike the ball.

Control of the additional weight from the counterweight 3 and thus, of the additional momentum of the swing is facilitated by the novel arrangement of hosel 4. As shown in FIG. 1*b* the hosel is inserted in socket 15 at a portion of the counterweight opposite or away from the striking portion 2. The hosel extends 5 forward towards the striking portion, centered along plane P1 (formed as a vertical plane through the axis centroids C1 and C2), and upwards to be substantially above the striking portion. Shaft 20 is inserted in socket 16 in a manner which would allow the shaft to extend along plane P1 and remain substantially vertical with respect to horizontal surface H1.

However, in order to facilitate the taste of individual golfers, socket 16 can be formed so that shaft 20 would extend at a 10° angle with respect to the vertical plane P1 as shown in FIG. 1*a*. This angle is not critical and can be adjusted according to the tastes of individual golfers. Also, the angle at which the hosel 4 extends from counterweight 3 can likewise be adjusted in accordance to the tastes and physical requirements of individual golfers. Thus, while the 40° angle depicted is a general optimal measurement, there is no requirement in the present invention that this value be used. Also, the hosel 4 can be connected to counterweight 3 in a manner other than the use of socket 15 depicted in FIG. 1*b* since the connection and the exact measurements are not at all critical to the present invention.

Of substantial concern to the present invention is the ultimate relationship between the hosel, the shaft and the counterweight- striking portion combination. In order to control the increased momentum generated by the inventive golf head 1, it is preferable that the hosel 4 extends to a position that would place the shaft 20 at approximately the balance point between the front and the rear of the head. Such positioning would allow the momentum of the head to be more easily controlled, and would place the shaft sufficiently close to the striking face 5 that the golfer would easily be able to see where the striking surface would impact the ball to better control the direction of the putt. Plane P1 (through centroids C1 and C2) also delineates the balance point from side-to-side across the striking surface 5 of striking portion 2. Placing the shaft 20 at this point allows the golfer to have more control over the position of the striking surface, thereby avoiding undesired skewing of the head when making a putt.

Thus, the shaft 20 is positioned at an approximate point of front-to-rear balance and side-to-side balance of the head 1. While the exact point of balance need not be the position of the shaft to achieve full benefits of the present invention, it has been found that such balance greatly enhances the "feel" of the putter, and apparently provides improved control to the golfer. Since the "feel" to the golfer is a subjective matter, and is usually not extremely accurate, the substantial approximations of the aforementioned points of balance can be used for positioning the shaft 20. The points of balance can be proximate to the extent that the golfer still "feels" balance from front to rear and side to side of the putter head 1.

The measurements depicted in FIGS. 1*a* and 1*b* describe only one embodiment of the present invention believed to be optimal for golfers in general. However, the present invention can be carried out when these measurements are varied to accommodate the various physical needs and tastes of individual golfers. While the head is made of aluminum, other materials can be used. Further, as previously stated, the second bell-shaped portion 12 can be of any shape to facilitate the alignment of centroids C1 and C2, and which does not sufficiently undermine the approximate front to rear balance and side to side balance of the shaft 20 placement.

The configuration of the present invention, which includes a smaller bell-shaped configuration constituting section 12, is believed to provide an enhanced "sweet spot" 19 (outlined by the dotted circle) approximately the size of a golf ball. The "sweet spot" is elevated slightly above the bottom surface 6 of the striking portion in order to allow the golfer to raise the putter slightly in order to avoid surface obstructions. Preferably, in this embodiment the "sweet spot" 19 coincides with the placement and diameter of a cylinder constituting counterweight 3. Thus, the momentum of the putter head is fully focused on the surface of the ball where desired.

While the single preferred embodiment is depicted in FIGS. 1*a* and 1*b*, and a number of variations are described in the Specification, the invention is not be limited thereby. Rather, the present invention should be considered to include any modifications, permutations, variations, extensions or equivalent arrangements falling within the scope of the following claims.

What is claimed:

1. A golf putter including a head, a shaft and a hosel connecting said head and said shaft, said head comprising a. a substantially bell-shaped striking portion with a striking surface arranged along a substantially vertical plane, said striking portion having a horizontal centroid, and a lower surface arranged along a substantially horizontal plane, said lower surface and said striking surface being connected by a beveled surface; and, b. a counterweight having a longitudinal axis extending from said striking portion in a direction perpendicular and opposite said striking surface, said counterweight having a centroid extending along said longitudinal axis and aligned with said centroid of said striking portion;

said hosel being connected to said counterweight opposite said striking portion, and extending at an angle upward from said counterweight and towards said striking surface; and, said shaft being connected at an end of said hosel opposite to a connection between said hosed and said counterweight.

2. The golf putter of claim 1, wherein said beveled surface is at a 45° angle to said striking surface and said lower surface.

3. The golf putter of claim 1, wherein said centroid of said striking portion aligns with a horizontal diameter of a ball resting on a horizontal surface aligned with said lower surface of said striking portion.

4. The golf putter of claim 1, wherein said hosel extends along a vertical plane formed through the centroid of said counterweight.

5. The golf putter of claim 4, wherein said shaft is connected to said hosel at a point which is essentially a center of gravity of said head as measured from said striking surface to an end of said counterweight opposite said striking surface.

6. The golf putter of claim 4, wherein said shaft is connected to said hosel at a point substantially at a center of gravity of said head as measured cross said striking surface.

7. The golf putter of claim 6, wherein said shaft extends at an angle from the vertical plane formed through the centroid of the counterweight.

8. The golf putter of claim 7, wherein said angle of said shaft is approximately 10°.

9. The golf putter of claim 4, wherein said hosel extends at an angle of 40° from said counterweight at a point where said hosel connects to said counterweight.

10. The golf putter of claim 3, wherein said striking portion comprises two sections, both said sections having a substantially bell-shaped configuration.

11. The golf putter of claim 10, wherein said second section has a smaller diameter than said first section.

12. The golf putter of claim 2, wherein said striking portion has two opposite peaks of it's bell shape, each said peak extending at an angle of approximately 3° from horizontal.

* * * * *